US005967867A

United States Patent [19]

Rinzaki et al.

[11] Patent Number: 5,967,867

[45] Date of Patent: Oct. 19, 1999

[54] CONTROLLER FOR BOAT PROPELLING DEVICE

[75] Inventors: Shoichi Rinzaki; Yoshihiro Harada, both of Wako; Kazumichi Hamaguchi, Niiza, all of Japan

[73] Assignees: Honda Giken Kogyo Kabushiki Kaisha, Tokyo; Honda Access Corp., Saitama, both of Japan

[21] Appl. No.: 09/055,777

[22] Filed: Apr. 7, 1998

[30] Foreign Application Priority Data

Apr. 10, 1997 [JP] Japan ..... 9-092537

[51] Int. Cl.[6] ..... B60K 41/00

[52] U.S. Cl. ..... 440/87; 440/84; 74/480 B

[58] Field of Search ..... 440/84–87; 74/480 B

[56] References Cited

U.S. PATENT DOCUMENTS 4,801,282 1/1989 Ogawa et al. ..... 440/84

FOREIGN PATENT DOCUMENTS 3-297 1/1991 Japan .

*Primary Examiner*—Ed Swinehart

*Attorney, Agent, or Firm*—Nikaido, Marmelstein, Murray & Oram LLP

[57] ABSTRACT

A grip 6*b* is projectingly provided on one side of an upper end of a control lever $\mathbf{4}_1$, $\mathbf{4}_2$ of a controller for a boat propelling device, and a switch accommodating portion 7*b* is projectingly provided on the other side. Control switches 14 and 15 are mounted in the switch accommodating portion 7*b*. The switch accommodating portion 7*b* is formed, on its front surface on the side of an operator, with an operating face 23 which is inclined, so that it comes closer to a center plane 21 extending laterally of the control lever $\mathbf{4}_1$, $\mathbf{4}_2$ at a laterally outer location. The control switches 14 and 15 have operating buttons 14*a* and 15*a* mounted to face the operating face 23. Thus, when the operator grasps the grip portion of the control lever, the thumb of his or her hand is naturally opposed to the operating buttons of the control switches and hence, the operator can extremely easily operate the operating buttons.

3 Claims, 13 Drawing Sheets

CONTROLLER FOR BOAT PROPELLING DEVICE

BACKGROUND OF THE INVENTION

1. Field of the Invention

The present invention relates to a controller for a boat propelling device, which includes a control lever mounted to a control box placed in a cockpit of a boat for performing switching-over of the propelling device between forward and backward movement positions and opening and closing of a throttle valve by a turning operation of the lever in a longitudinal or front-and-rear (bow-and-stern) direction of the boat, the control lever having a grip portion projectingly provided on one side of an upper end thereof and a switch accommodating portion projectingly provided on the other side of the upper end thereof, and a control switch mounted in the switch accommodating portion for performing trimming and tilting of the propelling device.

2. Description of the Related Art

Such a controller of a boat propelling device is already known, for example, as disclosed in Japanese Utility Model Application Laid-open No. 3-297. In such conventional controller of the boat propelling device as shown in the mentioned publication, an operating surface of the switch accommodating portion at which an operating button of the control switch is faced is formed at right angles or in parallel to a center plane extending laterally of the control lever.

In such conventional controller for the boat propelling device, however, when an operator grasps the grip portion of the control lever, the thumb of his or her hand is unnaturally opposed to the operating button of the control switch, and thus the operability of the operating button is not satisfactorily good.

SUMMARY OF THE INVENTION

Accordingly, it is an object of the present invention to provide a controller of the above-described type for a boat propelling device, wherein when the operator grasps the grip portion of the control lever, the thumb of his or her hand is naturally opposed to the operating button of the control switch, so that he or she can extremely easily operate the operating button.

To achieve the above object, according to a first aspect and feature of the present invention, there is provided a controller for a boat propelling device, comprising a control lever mounted to a control box placed in a cockpit of a boat for performing switching-over of the propelling device between forward and backward movement positions and opening and closing of a throttle valve by a turning operation of the lever in a longitudinal direction of the boat, the control lever having a grip portion projectingly provided on one side of an upper end thereof and a switch accommodating portion projectingly provided on the other side of said upper side, and a control switch mounted in the switch accommodating portion for performing trimming and tilting of the propelling device, characterized in that the switch accommodating portion is formed, on a front surface thereof on a side of an operator, with an operating face which is inclined so as to come closer to a center plane extending laterally of the control lever at a laterally outer location, and the control switch includes an operating button placed to face the operating face.

With the first feature, the thumb of the operator's hand grasping the grip portion can be naturally opposed to the operating button only by extending the thumb toward the operating face, thereby easily operating the operating button.

According to a second aspect and feature of the present invention, in addition to the above first feature, the control lever comprises an arm member pivotally supported on the control box and having an arm portion, and first and second side members which are secured to an upper portion of the arm member to sandwich the arm member therebetween from the left and right sides and which have a grip portion and a switch accommodating portion, respectively, the arm member and the first side member 6 being formed symmetrically with respect to the center plane.

With the second feature, the arm members and the first side members can be used commonly for the control levers operated by right and left hands by disposing them in the laterally reversed positions, thereby providing an excellent mass producibility and considerably reducing the cost.

According to a third aspect and feature of the present invention, in addition to the first or second feature, the switch accommodating portion has a back surface which is formed as a convex curved surface.

With the third feature, the volume of the switch accommodating portion can be sufficiently ensured irrespective of the inclined operating face of the front surface to easily perform the placement of the control switch.

The above and other objects, features and advantages of the invention will become apparent from the following description of the preferred embodiments taken in conjunction with the accompanying drawings.

DETAILED DESCRIPTION OF THE PREFERRED EMBODIMENTS

The present invention will now be described by way of particular embodiments with reference to the accompanying drawings.

Figure 1:
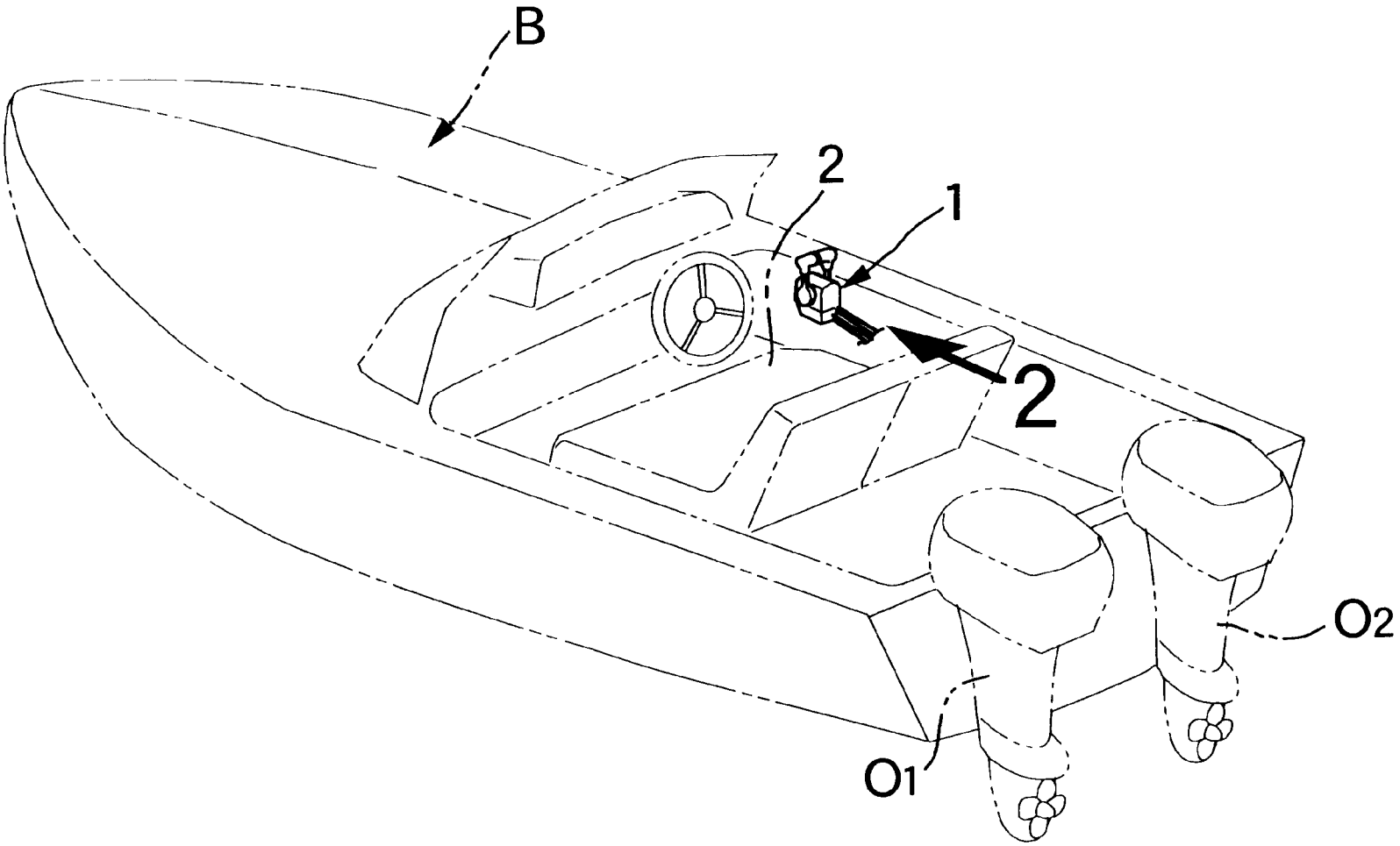
FIG. 1 is a perspective view of an entire boat provided with a controller for a propelling device according to a first embodiment of the present invention.
Figure 2:
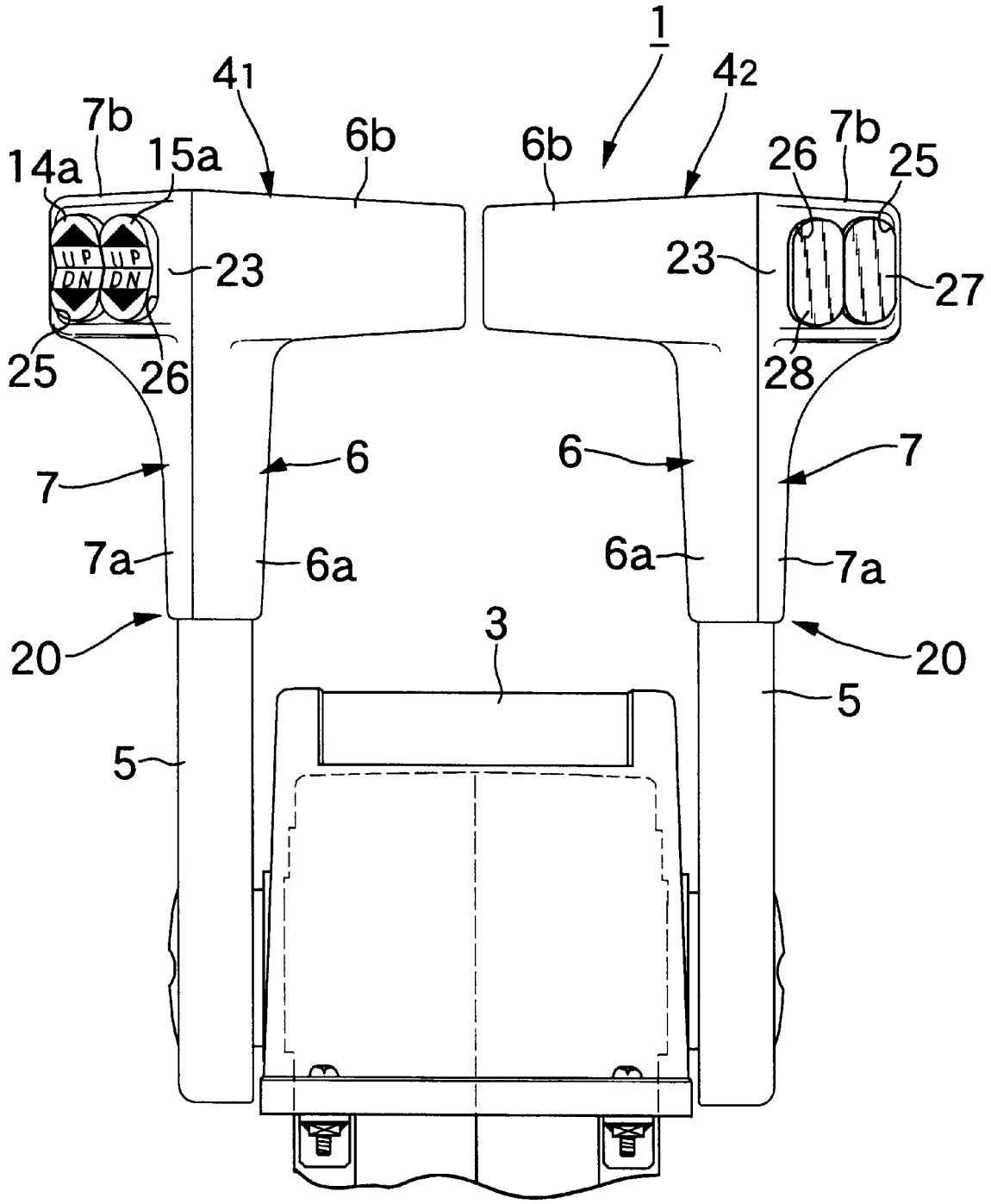
FIG. 2 is a front view (a view taken in a direction of an arrow 2 in FIG. 1) of the controller for the propelling device.
Figure 3:
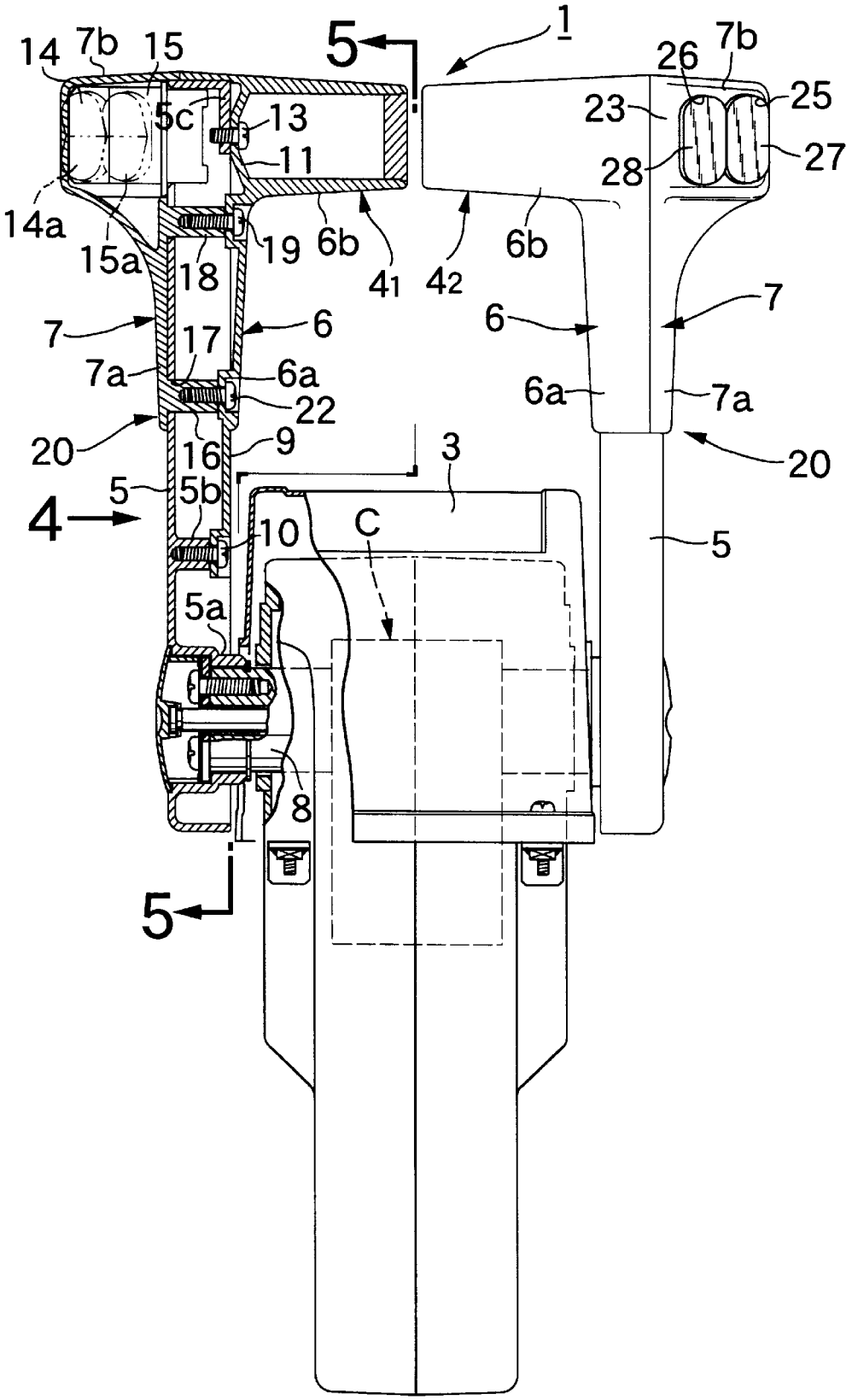
FIG. 3 is a vertical sectional front view of an essential portion of the controller for the propelling device.

A first embodiment of the present invention shown in FIGS. 1 to 6 will be first described. Referring to FIG. 1, a pair of left and right outboard engine systems $O_1$ and $O_2$ as propelling devices are trimmably and tiltably mounted to a transom of a boat B. A controller 1 according to the embodiment of the present invention for controlling the outboard engine systems $O_1$ and $O_2$ is disposed on the right of a cockpit 2 of the boat B.

As shown in FIGS. 2 to 6, the controller 1 includes a control box 3, and a pair of left and right control levers $\mathbf{4}_1$ and $\mathbf{4}_2$ pivotally carried on opposite left and right sidewalls of the control box 3 for turning movement in a longitudinal or front-and-rear direction of the boat B. Each of the control levers $\mathbf{4}_1$ and $\mathbf{4}_2$ is turned forwards and rearwards from a neutral position in which a forward/backward movement switch-over device of the corresponding outboard engine system $O_1$, $O_2$ is brought into a neutral state, and a throttle valve in an intake system of an engine in the outboard engine system $O_1$, $O_2$ is maintained at an idle opening degree. When each of the control levers $\mathbf{4}_1$ and $\mathbf{4}_2$ is turned forwards from the neutral position, the forward/backward movement switch-over device is switched over to a forward movement position, and the opening degree of the throttle valve is increased. Reversely, when each of the control levers $\mathbf{4}_1$ and $\mathbf{4}_2$ is turned backwards from the neutral position, the forward/backward movement switch-over device is switched over to a backward movement position, and the opening degree of the throttle valve is increased. A remote control mechanism C adapted to put the control levers $\mathbf{4}_1$ and $\mathbf{4}_2$ and the outboard engine systems $O_1$ and $O_2$ into communication with each other is housed in the control box 3.

The left control lever $\mathbf{4}_1$ is comprised of three main components: an arm member 5, a first side member 6 on the side of the control box 3 and a second side member 7 on the side opposite from the control box 3, which are secured to an upper portion of the arm member 5 to sandwich the arm member 5 therebetween from the left and right.

The arm member 5 assumes an angular U-shape in section with one side opened, and a boss 5*a* is integrally formed at a lower portion of the arm member 5 and connected to an input shaft 8 of the remote control mechanism C. In connecting the boss 5*a* to the input shaft 8, the arm member 5 is disposed with its opened face turned toward the control box 3.

The first side member 6 is comprised of a skirt portion 6*a* of an angular U-shape in section which covers an inner side of an upper portion of the arm member 5 adjacent the control box 3, and a hollow cylindrical grip portion 6*b* which protrudes from one side of an upper end of the skirt portion 6*a* to a laterally central portion of the control box 3. The skirt portion 6*a* is integrally formed with a mounting piece 9 which extends downwards and is fitted into the opening in the arm member 5, with its lower end being secured to the mounting boss 5*b* on the inner wall of the arm member 5 by a machine screw 10. The grip portion 6*b* is integrally formed with a partition wall 11 which traverses the hollow inside in the grip portion 6*b* and which is secured to the mounting piece 5*c* at the upper end of the arm member 5 by a machine screw 13.

The second side member 7 is comprised of a skirt portion 7*a* of an angular U-shape in section which covers an outer side of the upper portion of the arm member 5, and a hollow switch-accommodating portion 7*b* which protrudes from one side of an upper end of the skirt portion 7*a* in a direction opposite from the grip portion 6*b*. First and second control switches 14 and 15 mounted to the upper end of the arm member 5 laterally adjacent each other are accommodated in the switch-accommodating portion 7*b*.

A positioning boss 16 is projectingly provided on an inner side of a lower area of the skirt portion 7*a* of the second side member 7. The positioning boss 16 is fitted into a positioning bore 17 in the sidewall of the arm member 5 and coupled to the skirt portion 6*a* of the first side member 6 by a machine screw 22. A mounting boss 18 is also projectingly provided on the inner side of an upper area of the skirt portion 7*a* of the second side member 7, and the skirt portion 6*a* of the first side member 6 is secured to the mounting boss 18 by a machine screw 19.

In this manner, the first and second side members 6 and 7 are secured to the arm member 5 and connected to each other. The skirt portions 6*a* and 7*a* of the side members 6 and 7 constitute an arm section 20 of the control lever $\mathbf{4}_1$ together with the arm member 5.

Figure 4:
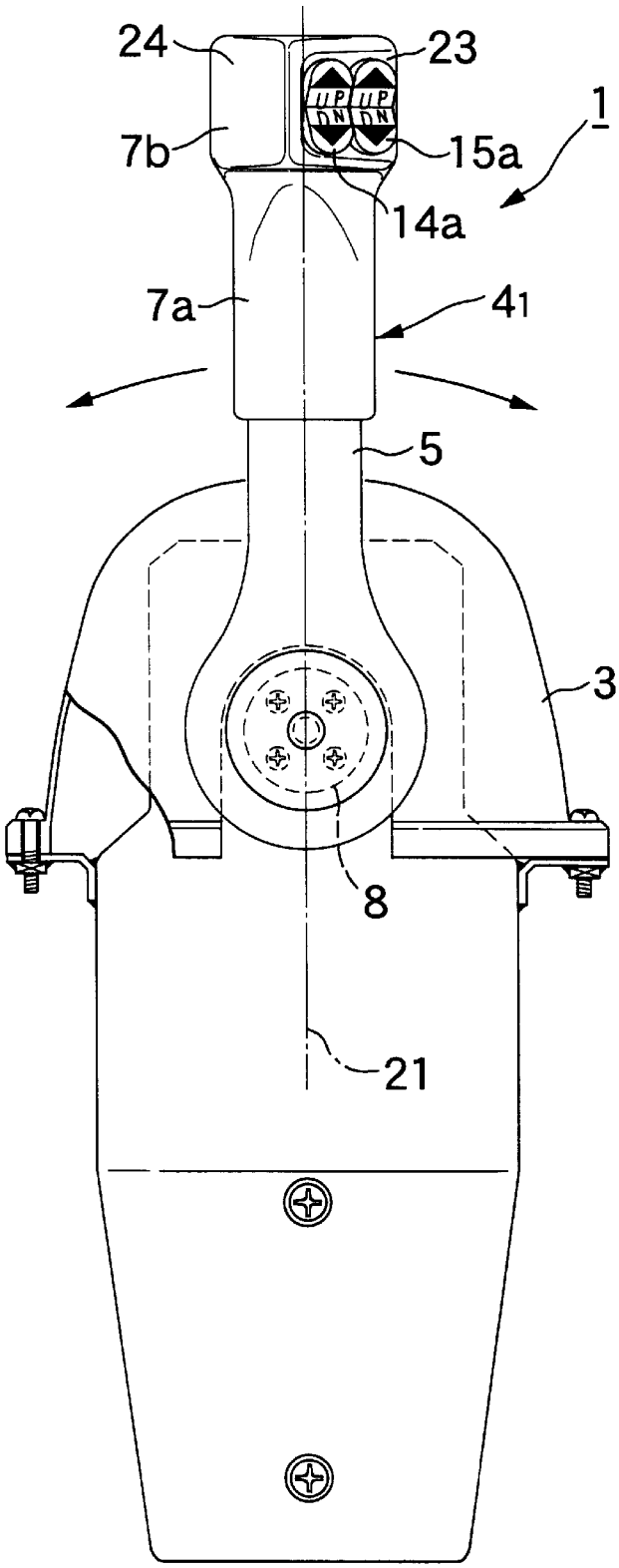
FIG. 4 is a view taken in a direction of an arrow 4 in FIG. 3.
Figure 5:
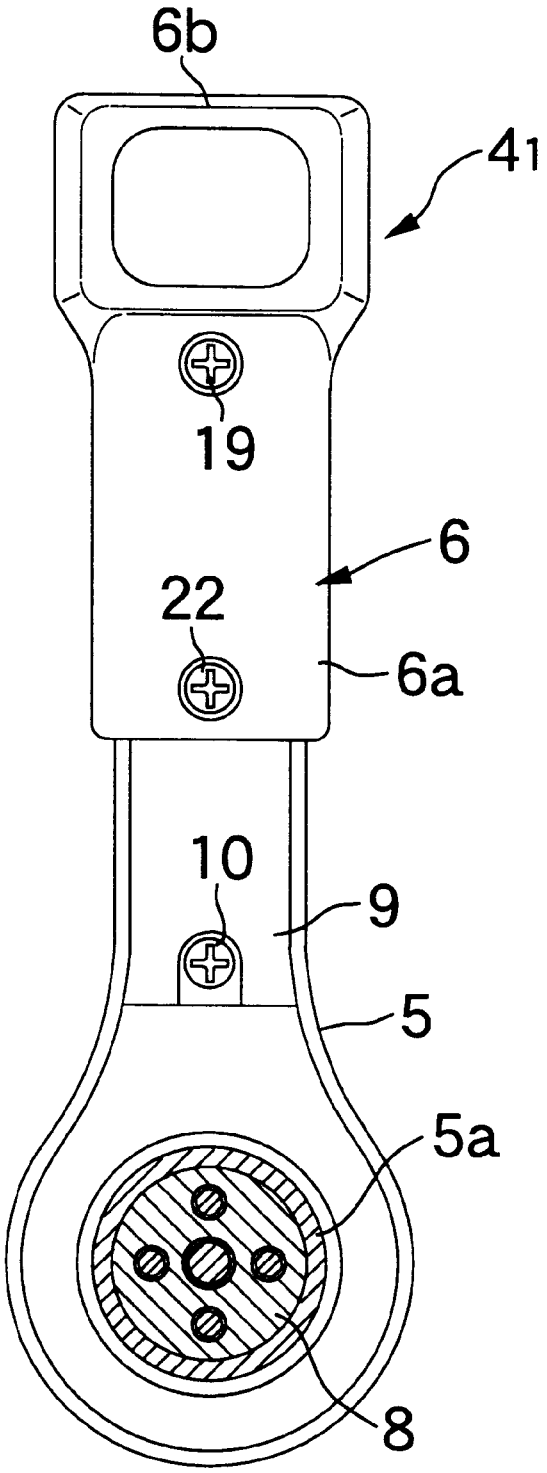
FIG. 5 is a sectional view taken along a line 5—5 in FIG. 3.

As shown in FIGS. 4 and 5, the arm member 5 and the first side member 6 are formed longitudinally symmetrically with respect to a center plane 21 extending laterally of the control lever $\mathbf{4}_1$.

The second side member 7 is formed longitudinally non-symmetrically with respect to the center plane 21. More specifically, an operating face 23 is formed on a front surface of the switch-accommodating portion 7*b* on the side of an operator and inclined, so that it is closer to the center plane 21 at a laterally outer location on the switch-accommodating portion 7*b*, and a back face 24 opposite from the operating face 23 is formed as a convex curved face.

A pair of left and right vertically elongated bores 25 and 26 are provided adjacent to each other in the operating face 23, and a seesaw-type operating buttons 14*a* and 15*a* of the first and second control switches 14 and 15 are disposed within the elongated bores 25 and 26, respectively.

The first control switch 14 is of a normally opened type, and if an UP side or a DN side of the operating button 14*a* is pushed down, a trimming/tilting device (not shown) of the left outboard engine system $O_1$ is operated to tilt the outboard engine system $O_1$ in an ascending or descending direction. The second control switch 15 is also of a normally opened type, and if an UP side or a DN side of the operating button 15*a* is pushed down, a trimming/tilting device (not shown) of the right outboard engine system $O_2$ is operated to tilt the outboard engine system $O_2$ in an ascending or descending direction.

The right control lever $\mathbf{4}_2$ has a construction symmetric with the left control lever $\mathbf{4}_1$, except that it does not include control switches 14 and 15. In Figures, portions or components of the right control lever $\mathbf{4}_2$ corresponding to those of the left control lever $\mathbf{4}_1$ are designated by like reference characters.

The operation of this embodiment will be described below.

The left and right control levers $\mathbf{4}_1$ and $\mathbf{4}_2$ are formed symmetrically with each other. Moreover, the arm members 5 and first side members 6 of the left and right control levers $\mathbf{4}_1$ and $\mathbf{4}_2$ are formed longitudinally symmetrically with respect to the central planes 21 extending laterally of the control levers $\mathbf{4}_1$ and $\mathbf{4}_2$, and the second side members 7 of the left and right control levers $\mathbf{4}_1$ and $\mathbf{4}_2$ are formed longitudinally non-symmetrically with respect to the central planes 21. Therefore, the arm members 5 and the first side members 6 each having the same structure can be used commonly for the left and right control levers $\mathbf{4}_1$ and $\mathbf{4}_2$ by disposing them in laterally reversed states. Thus, it is possible to provide an excellent mass producibility and to considerably reduce the cost. In this case, blind lids 27 and 28 are fitted into the elongated bores 25 and 26 in the right control lever $4_1$ having no control switches 14 and 15.

Figure 6:
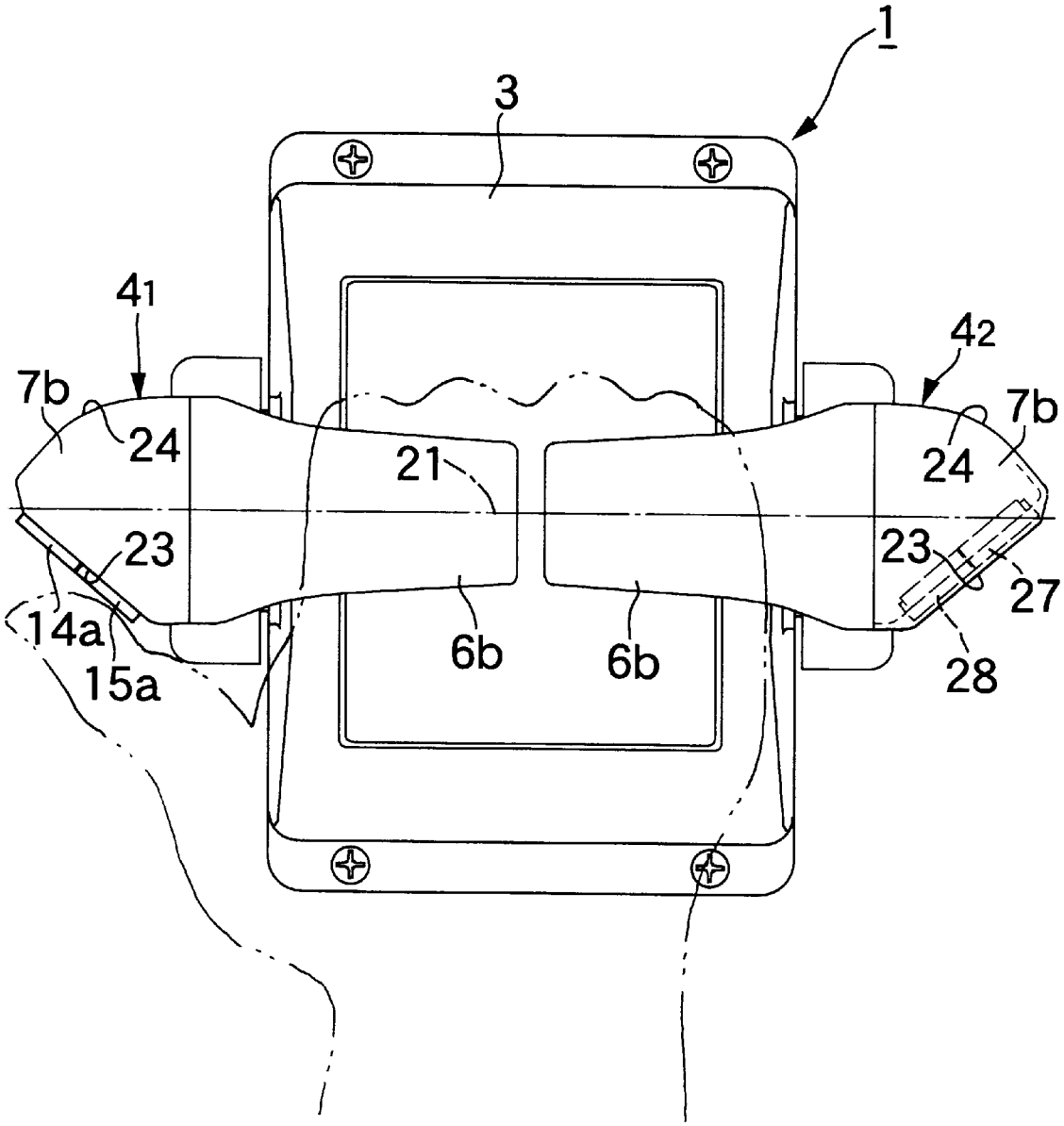
FIG. 6 is a plan view of the controller for the propelling device shown in FIG. 2.

In steering the outboard engine systems $O_1$ and $O_2$, if the operator grasps the grip portions 6*b* of the left and right control levers $4_1$ and $4_2$ simultaneously by his or her right hand, as shown in FIG. 6 to turn both of the control levers $4_1$ and $4_2$ forwards from the neutral positions, the forward/backward movement switch-over devices of the left and right outboard engine systems $O_1$ and $O_2$ can be switched over to the forward movement positions to increase the rotation of the engine. Reversely, if the control levers $4_1$ and $4_2$ are turned backwards, the forward/backward movement switch-over devices of the left and right outboard engine systems $O_1$ and $O_2$ can be switched over to the backward movement positions to increase the rotation of the engine.

If the UP side or DN side of the operating button 14*a* or 15*a* of either the left or right control switch 14 or 15 is pushed down during cruising of the boat, the trimming of the corresponding outboard engine system $O_1$ or $O_2$ can be carried out.

Further, if the operator returns the left and right control levers $4_1$ and $4_2$ to the neutral positions and keeps pushing of the UP or DN sides of the operating buttons 14*a* and 15*a* of the left and right control switches 14 and 15 simultaneously, while grasping the left and right grip portions 6*b*, the tilting-up or tilting-down of the left and right outboard engine systems $O_1$ and $O_2$ can be carried out simultaneously.

The operating face 23 faced by the left and right operating buttons 14*a* and 15*a* in the switch-accommodating portion 7*b* is formed as a slant which is closer to the center plane 21 of the control lever $4_1$, $4_2$ at the laterally outer location on the switch accommodating portion 7*b* and hence, if the operator extends the thumb of his or her right hand grasping the grip portion 6*b* toward the operating face 23, the thumb extremely naturally confronts the operating buttons 14*a* and 15*a*. Thus, the operator can operate the operating buttons 14*a* and 15*a* extremely easily.

Since the back surface 24 of the switch accommodating portion 7*b* is formed as the convex curved surface, the volume of the switch accommodating portion 7*b* can be sufficiently ensured irrespective of the inclined operating surface 23 to easily place the control switches 14 and 15.

Figure 7:
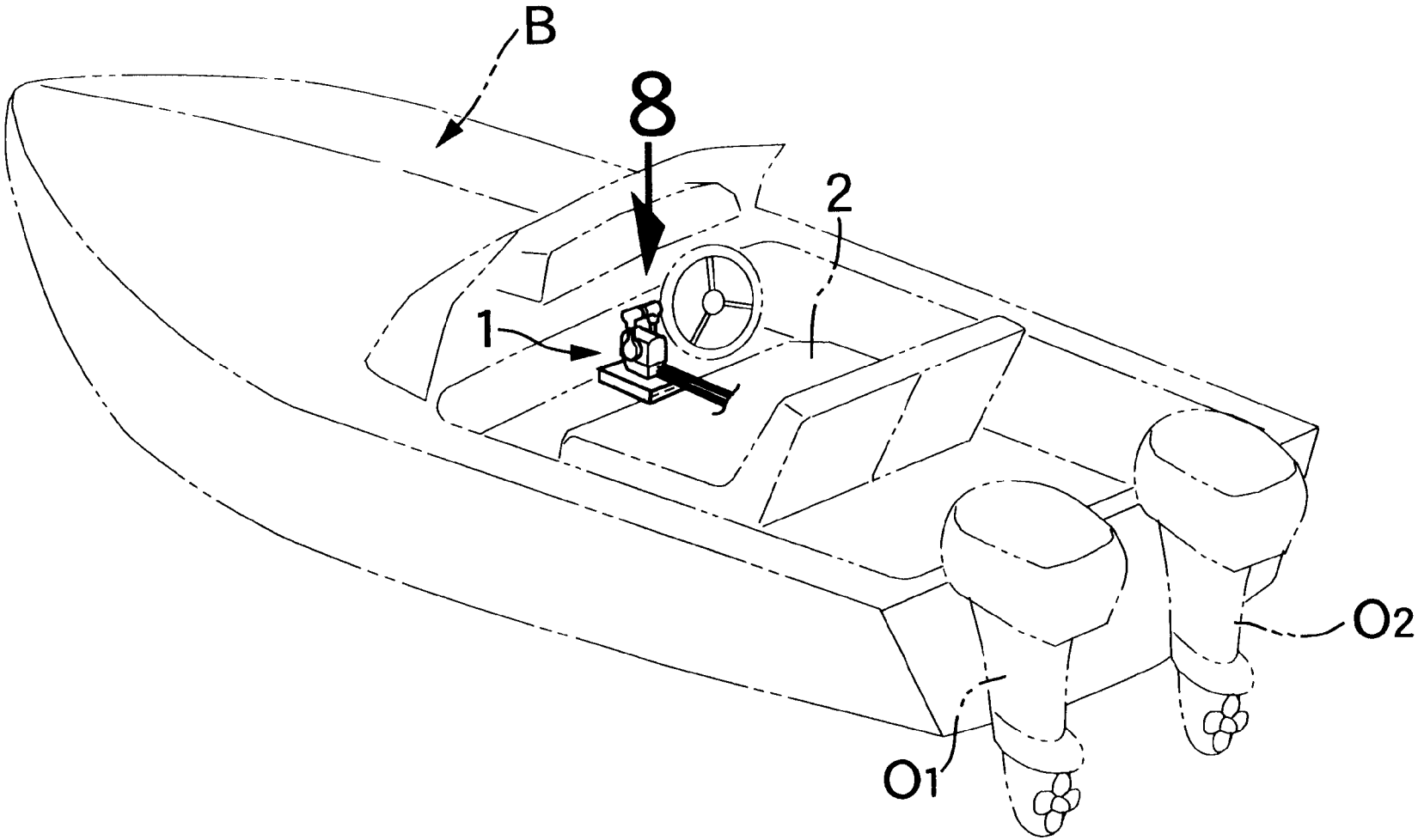
FIG. 7 is a perspective view of the entire boat provided with a controller for a propelling device according to a second embodiment of the present invention.
Figure 8:
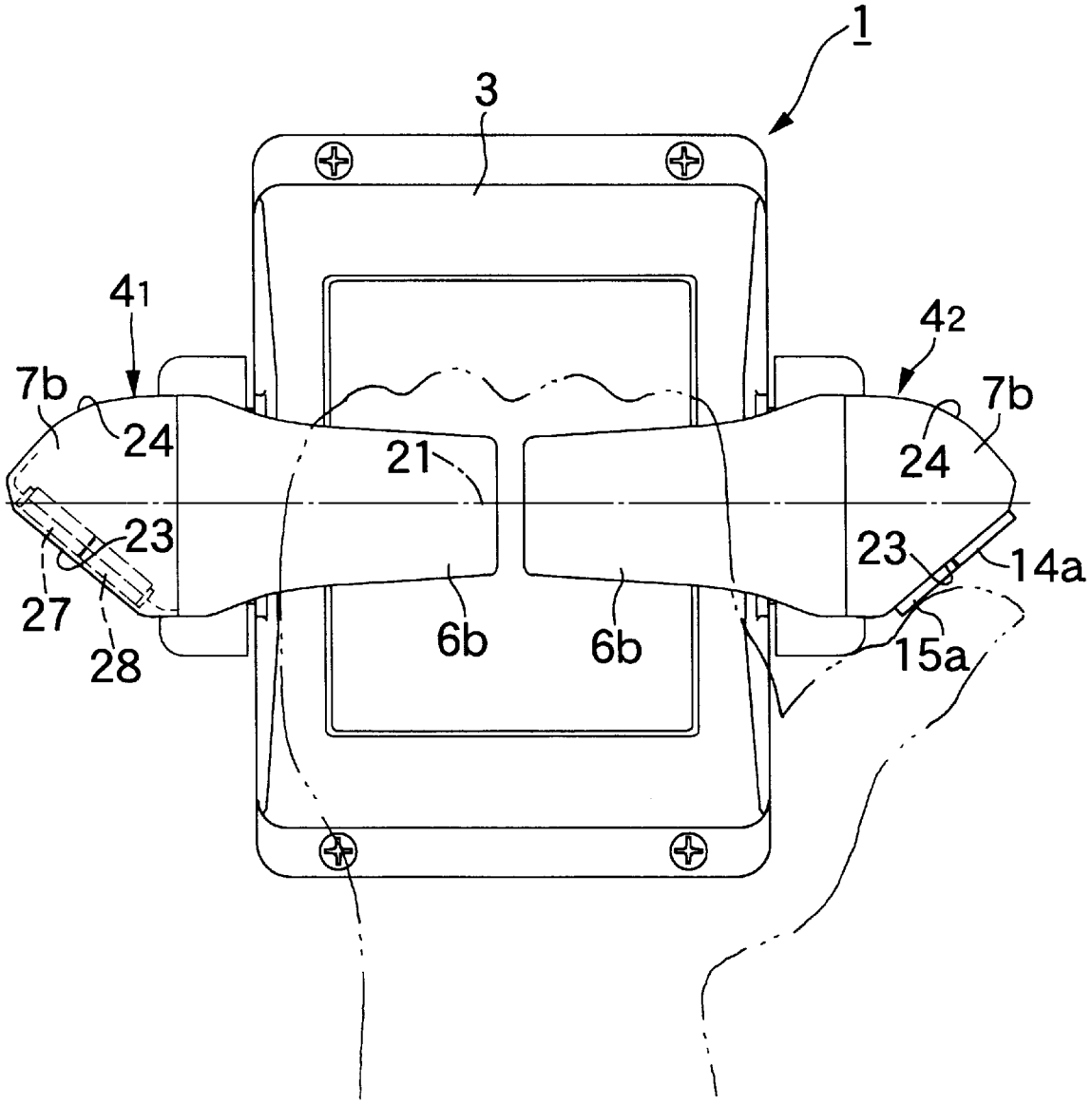
FIG. 8 is a plan view of the controller for the propelling device.

FIGS. 7 and 8 show a second embodiment of the present invention, wherein a controller 1 is placed on the left of a cockpit 2 to operate left and right control levers $4_1$ and $4_2$ by a left hand of an operator. Therefore, the controller 1 according to the second embodiment has a construction similar to that in the first embodiment, except that the control switches 14 and 15 are shifted to the right control lever $4_1$, $4_2$, so that the operator can operate them by the thumb of his or her left hand. In FIGS. 7 and 8, portions or components corresponding to those in the first embodiment are designated by like reference characters, and the description of them is omitted.

Figure 9:
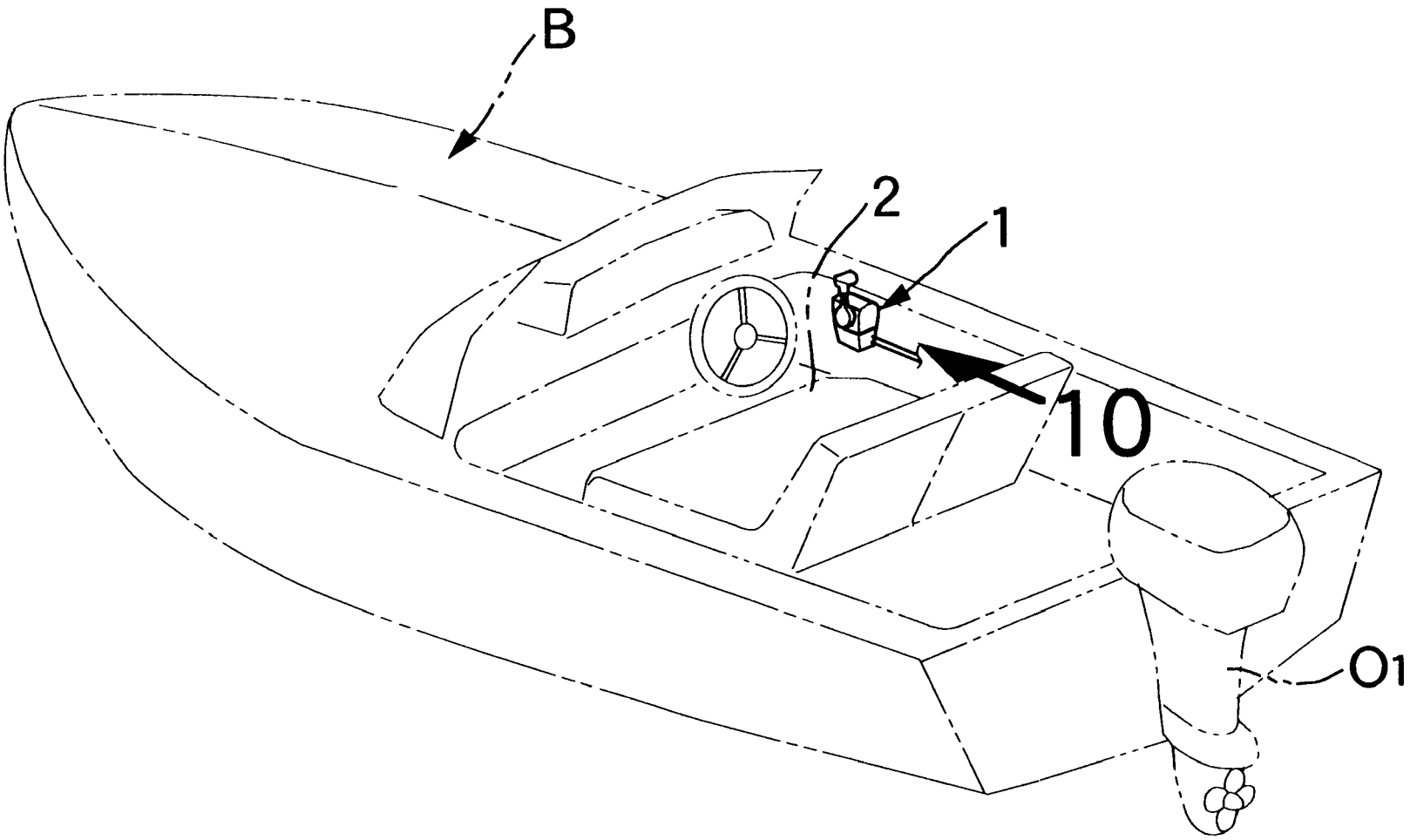
FIG. 9 is a perspective view of the entire boat provided with a controller for a propelling device according to a third embodiment of the present invention.
Figure 10:
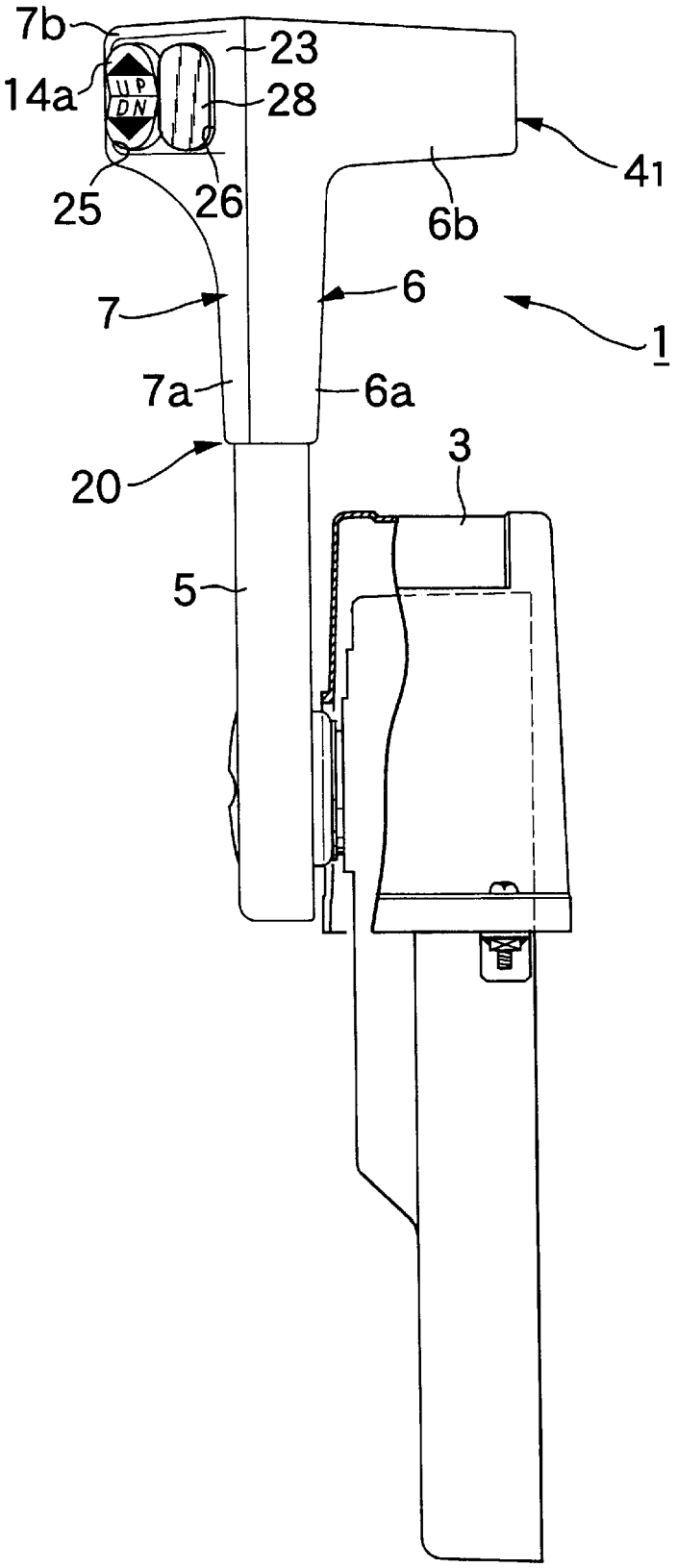
FIG. 10 is a front view (a view taken in a direction of an arrow 10 in FIG. 9) of the controller for the propelling device.
Figure 11:
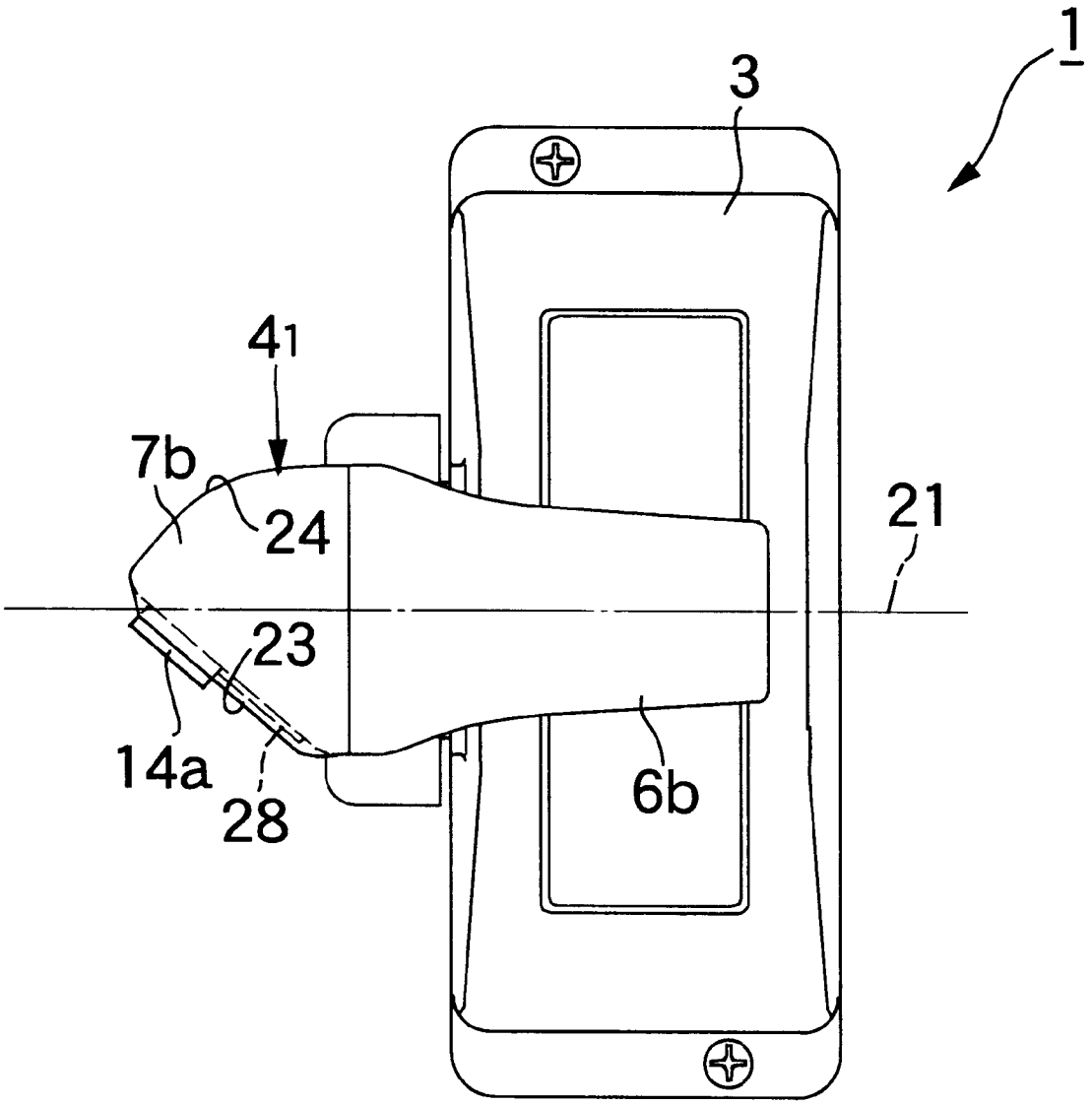
FIG. 11 is a plan view of the controller for the propelling device.

FIGS. 9 to 11 show a third embodiment of the present invention. A controller 1 including a single control lever $4_1$ operated by a right hand of an operator in correspondence with a single outboard engine system $O_1$ mounted to a transom of a boat B is placed on the right of a cockpit 2. In this case, the control lever $4_1$ may be left one of the control levers used in the first embodiment. However, the operating button 14*a* of the control switch 14 is placed to face one of the left and right elongated bores 25 and 26 in the switch accommodating portion 7*b*, and the other elongated bore is closed with a blind lid 28.

Figure 12:
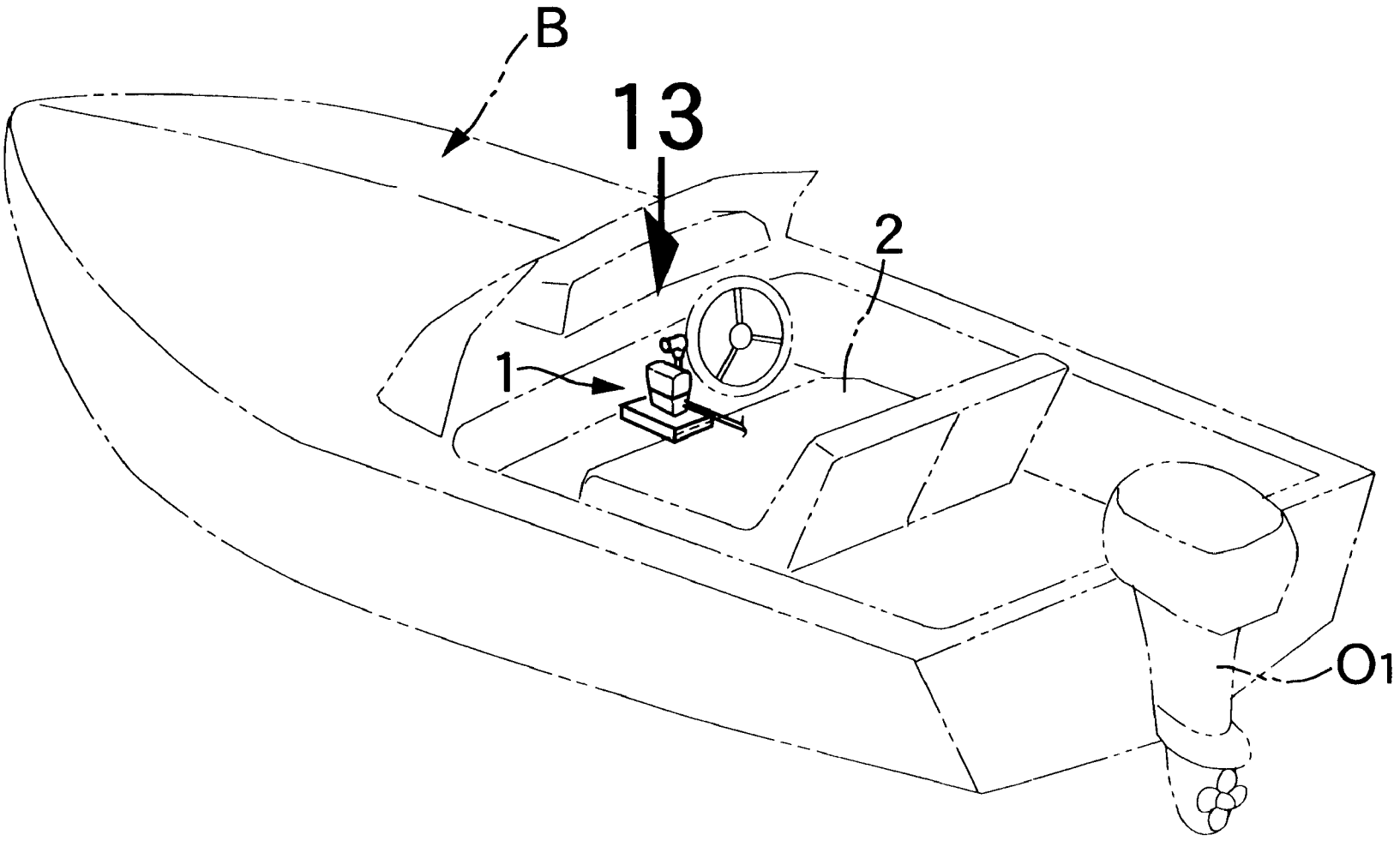
FIG. 12 is a perspective view of the entire boat provided with a controller for a propelling device according to a fourth embodiment of the present invention.
Figure 13:
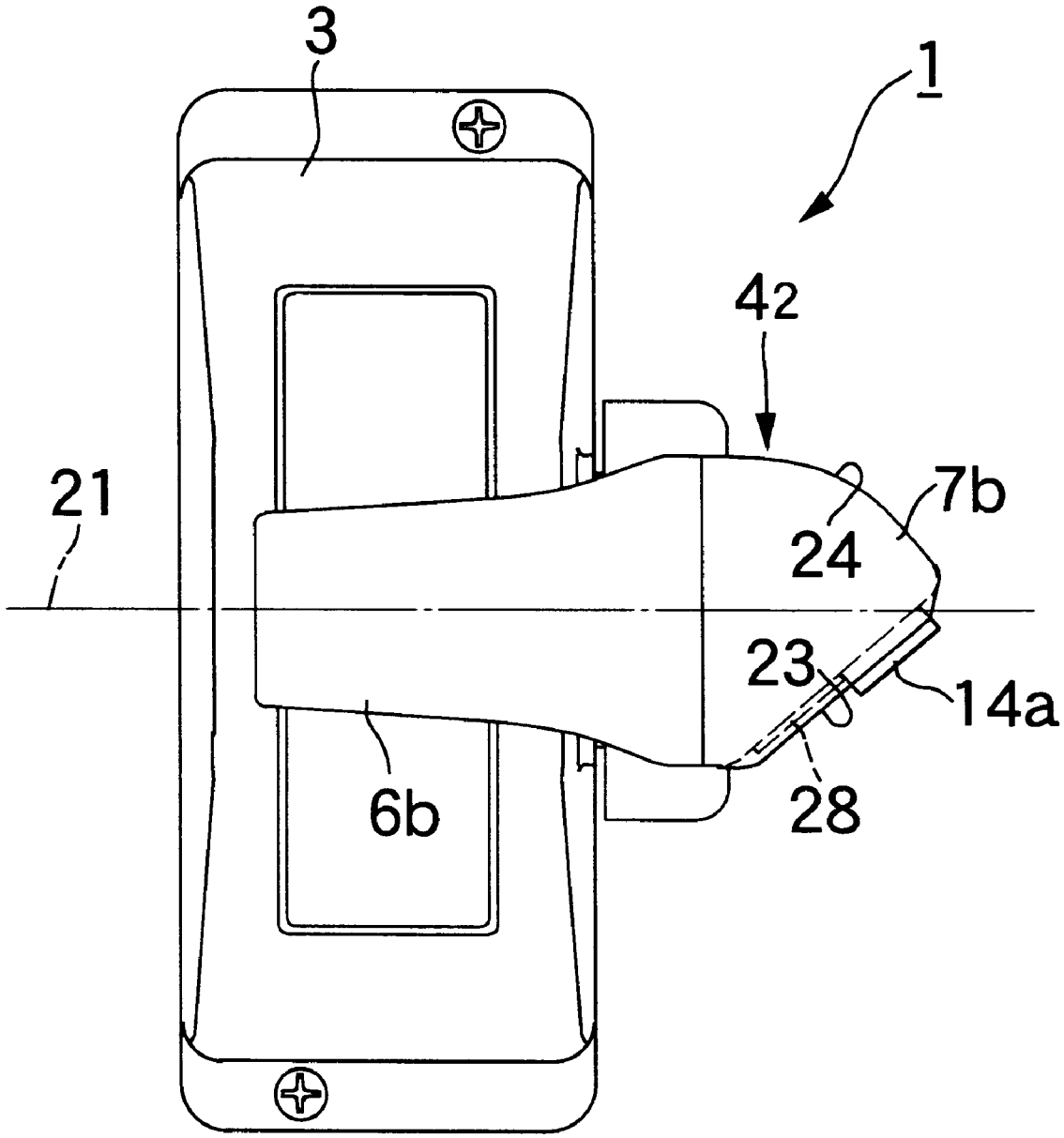
FIG. 13 is a plan view of the controller for the propelling device.

FIGS. 12 and 13 show a fourth embodiment of the present invention. A controller 1 having a single control lever $4_2$ operated by a left hand of an operator in correspondence to a single outboard engine system $O_1$ mounted to a transom of a boat B is placed on the left of a cockpit 2. In this case, the control lever $4_2$ may be right one of the control levers used in the second embodiment. However, the operating button 14*a* of the control switch 14 is placed to face one of the left and right elongated bores 25 and 26 in the switch accommodating portion 7*b*, and the other elongated bore is closed with a blind lid 28.

Although the embodiments of the present invention have been described in detail, it will be understood that the present invention is not limited to the above-described embodiments, and various modifications in design may be made without departing from the spirit and scope of the invention defined in claims. For example, the present invention is applicable to a controller to inboard and outboard engine systems.

What is claimed is:

1. A controller for a boat propelling device, comprising a control lever ($4_1$, $4_2$) mounted to a control box (3) placed in a cockpit (2) of a boat (B) for performing switching-over of the propelling device ($O_1$, $O_2$) between forward and backward movement positions and opening and closing of a throttle valve by a turning operation of the lever in a longitudinal direction of the boat (B), said control lever ($4_1$, $4_2$) having a grip portion (6*b*) projectingly provided on one side of an upper end thereof and a switch accommodating portion (7*b*) projectingly provided on the other side of said upper end, and a control switch (14, 15) mounted in the switch accommodating portion (7*b*) for performing trimming and tilting of the propelling device ($O_1$, $O_2$), characterized in that said switch accommodating portion (7*b*) is formed, on a front surface thereof on a side of an operator, with an operating face (23) which is inclined so as to come closer to a center plane extending laterally of the control lever ($4_1$, $4_2$) at a laterally outer location, and said control switch (14, 15) includes an operating button (14*a* and 15*a*) placed to face the operating face (23).

2. A controller for a boat propelling device according to claim 1, wherein said control lever ($4_1$, $4_2$) comprises an arm member (5) pivotally supported on the control box (3) and having an arm portion (20), and first and second side members (6, 7) which are secured to an upper portion of said arm member (5) to sandwich said arm member (5) therebetween from left and right sides and which have a grip portion (6*b*) and a switch accommodating portion (7*b*), respectively, said arm member (5) and said first side member (6) being formed symmetrically with respect to said center plane (21).

3. A controller for a boat propelling device according to claim 1 or 2, wherein said switch accommodating portion (7*b*) has a back surface (24) which is formed as a convex curved surface.

* * * * *